US005611410A

United States Patent [19]

Baillargeon

[11] Patent Number: 5,611,410

[45] Date of Patent: Mar. 18, 1997

[54] AERIAL PLATFORM ENCLOSURE APPARATUS

[76] Inventor: Paul D. Baillargeon, 103 Horse Corner Rd., Chichester, N.H. 03234

[21] Appl. No.: 500,704

[22] Filed: Jul. 11, 1995

[51] Int. Cl.[6] ..... B66F 11/04

[52] U.S. Cl. ..... 182/129; 182/2

[58] Field of Search ..... 182/2, 129

[56] References Cited

U.S. PATENT DOCUMENTS

| | | | |
|---|---|---|---|
| 3,695,390 | 10/1972 | Leigh | 182/2 |
| 4,069,891 | 1/1978 | McClung | 182/187 |
| 5,107,954 | 4/1992 | Fujimoto | 182/2 |
| 5,286,159 | 2/1994 | Honna | 182/2 |

*Primary Examiner*—Alvin C. Chin-Shue
*Attorney, Agent, or Firm*—William B. Ritchie

[57] ABSTRACT

An aerial platform utility enclosure designed to be easily installed upon an unenclosed aerial platform bucket. The enclosure protects the worker from environmental elements without reducing visibility out of the bucket because a polycarbonate plastic such as LEXAN is used to cover the entire enclosure. Upper and lower structural components of the enclosure are constructed out of a non-conductive material. The lower structural component is firmly attached to the bucket while rotation of the upper structure and the protective cover in a full circle allows the worker to have greater access too his surroundings without having to reposition the bucket.

8 Claims, 6 Drawing Sheets

AERIAL PLATFORM ENCLOSURE APPARATUS

BACKGROUND OF THE INVENTION

1. Field of the Invention

The invention relates to an aerial platform utility enclosure designed to be installed upon an otherwise unenclosed aerial platform structure.

2. Description of the Related Art

Cable splicers and others performing work from an aerial platform often must do so in inclement weather or in the alternative, postpone their task if the weather is too severe. Depending on the urgency of the work, time may be of the essence which necessitates working in such conditions. Likewise, for geographical locations that experience harsh winter months, cable splicers must typically endure exposure to the winter elements or rainy days to perform their work. Typical protective covers for aerial platforms are not rotatable and the degree of visibility from such enclosures are very limited which makes them unsuitable for workers who must view have a view of the entire work area in order to work as effectively and safely as if a protective enclosure was not installed. Also, typical protective covers have a limited available work area.

U.S. Pat. No. 3,695,390, issued to Leigh on Oct. 3, 1972, discloses an aerial lift having a workman's basket with a removable canvas-like protective covering that is attached to the basket. This enclosure consist of a canopy assembly and a support arm assembly affixed to the basket that is to be raised to the full line position once the aerial lift has arrived at the desired location. A side curtain assembly and a front curtain assembly are then snapped in place to provide protection for the worker.

U.S. Pat. No. 3,605,941, issued to Edwards on Sep. 20, 1971, discloses another form of an aerial lift with an enclosable workman's basket. A removable canopy assembly is provided for the top of the basket structure and consist of a collapsible framework which can be removed in warm weather. If desired, the protective covering can be made of a translucent material so that work performed during the daytime will not require a light. Once enclosed, the canopy does not rotate, but the worker is provided a relatively sealed enclosure for protection from environmental elements.

U.S. Pat. No. 3,917,026, issued to Hedges on Nov. 4, 1975, discloses still another variation of a protective enclosure for aerial platforms. This disclosure teaches the use of a modular three-part preformed lightweight panel assembly designed to be installed upon the outer structural surfaces of the frame members of an otherwise unenclosed aerial platform cage. While offering limited protection from the weather elements, the worker is not protected overhead and aft.

Full protective covers for aerial platforms indicative by the prior art are not rotatable and the degree of visibility from such enclosures are very limited which makes them unsuitable for workers who desire both unrestricted access and visibility of the entire work area.

Ideally, a worker operating from an aerial platform utilizing an enclosure for protection from inclement weather should provide the worker with flexibility in positioning the opening of the protective covering to a desired position without having to reposition the aerial platform. In addition, operation of an aerial platform near electrical powerlines requires safety precautions in order to avoid accidental contact with them. Thus, visibility through an environmental protective enclosure is important whenever the aerial platform is positioned in close proximity to electrical powerlines.

It would be an improvement on the current art to create an aerial platform enclosure apparatus that allows the protective enclosure to be positioned in the desired direction without having to reposition the aerial platform. However, when the aerial platform is repositioned, particularly in close proximity to high voltage electrical powerlines, visibility on all sides of the environmental protective enclosure, including overhead, would be an improvement on the current art so that accidental contact with the electrical powerlines is avoided.

SUMMARY OF THE INVENTION

It is an object of the invention to provide an aerial platform enclosure apparatus that can be easily installed and removed on an aerial platform basket.

It is another object of the invention to provide an aerial platform enclosure apparatus that protects the worker from inclement weather.

It is another object of the invention to provide an aerial platform enclosure apparatus that can be easily rotated 360 degrees in a horizontal plane while the aerial platform basket remains in a fixed position.

It is another object of the invention to provide an aerial platform enclosure apparatus that has an opening of sufficient size that permits the operator to work through the enclosure apparatus opening.

It is another object of the invention to provide an aerial platform enclosure apparatus that has a door that can be easily rotated 360 degrees in a horizontal plane in order to cover the enclosure apparatus opening.

It is another object of the invention to provide an aerial platform enclosure apparatus that is made of a transparent material to permit the worker visibility in all directions, including overhead.

It is another object of the invention to provide an aerial platform enclosure apparatus that can be inexpensively produced using primarily commercially available parts.

It is another object of the invention to provide an aerial platform enclosure apparatus that is constructed of durable, lightweight material.

It is another object of the invention to provide an aerial platform enclosure apparatus that is primarily constructed of non-conductive materials.

It is a final object of the invention to provide an aerial platform enclosure apparatus that will be sturdy enough to withstand winds generated when the enclosure apparatus is exposed while driving the aerial platform vehicle.

The invention is an enclosure apparatus for an aerial bucket. A substantially circular base having a base wall channel, a base window channel, an opening centered therein is provided. A substantially circular top having a top wall channel, a top window channel and a substantially transparent roof is also provided. A cylindrical wall that is substantially transparent is further provided. The wall is fixed within said top wall channel of said circular top and rotatably slidably disposed within said base wall channel of said base. The wall further has a window opening having a width. A cylindrical window also substantially transparent is provided. The window has substantially the same radius of curvature of said wall. The window is dimensioned to correspond to the window opening in said wall. The window is rotatably slidably disposed between said top window channel of said top and said base window channel of said base such that said window opening within said wall can be selectively opened up to the full width of said window opening by a user sliding said window. Attachment means is provided for rigidly but removably attaching said base to said bucket, wherein the user can rotate said wall to place said window opening in any desired position, said position being independent of the position of said bucket. Bearing means for facilitating the sliding rotation of said wall within said base wall channel is provided. Bearing means for facilitating the sliding rotation of said window within said base window wall channel is also provided.

DETAILED DESCRIPTION OF THE INVENTION

Figure 1:
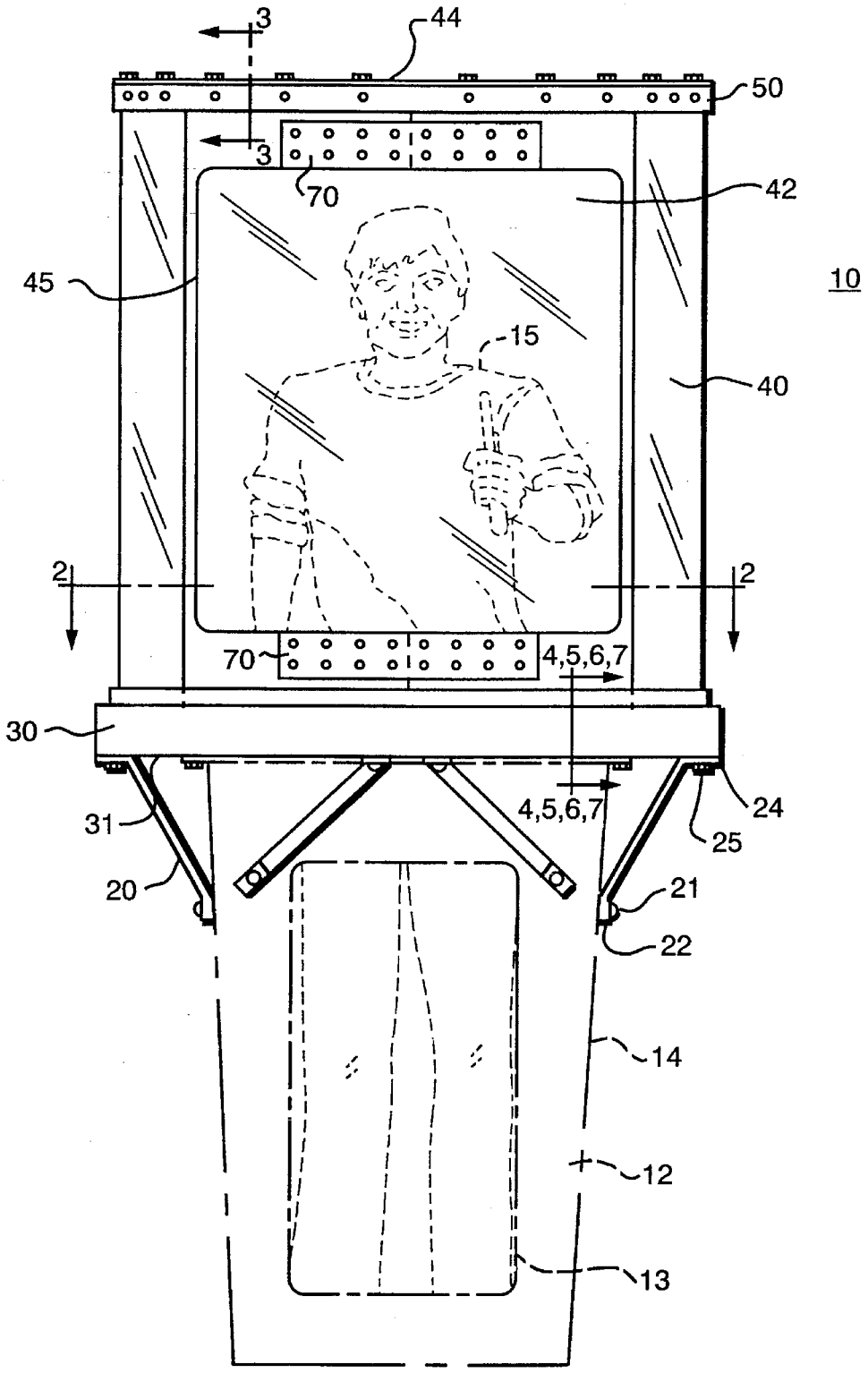
FIG. 1 is a front view of the enclosure apparatus in place on a typical aerial bucket.

FIG. 1 is a front view of enclosure apparatus 10 in place on a typical aerial bucket 12. Bucket 12 is representative of the type used at the end of a boom structure (not shown) which is positioned by worker 15 while in bucket 12 so that worker 15 can reach his objective. The bucket 12 is formed of a suitable plastic such as molded plastic impregnated with fiberglass and is of the size and strength to carry a human being. Ingress and egress of worker 15 is through opening 13 of bucket 12.

Figure 8:
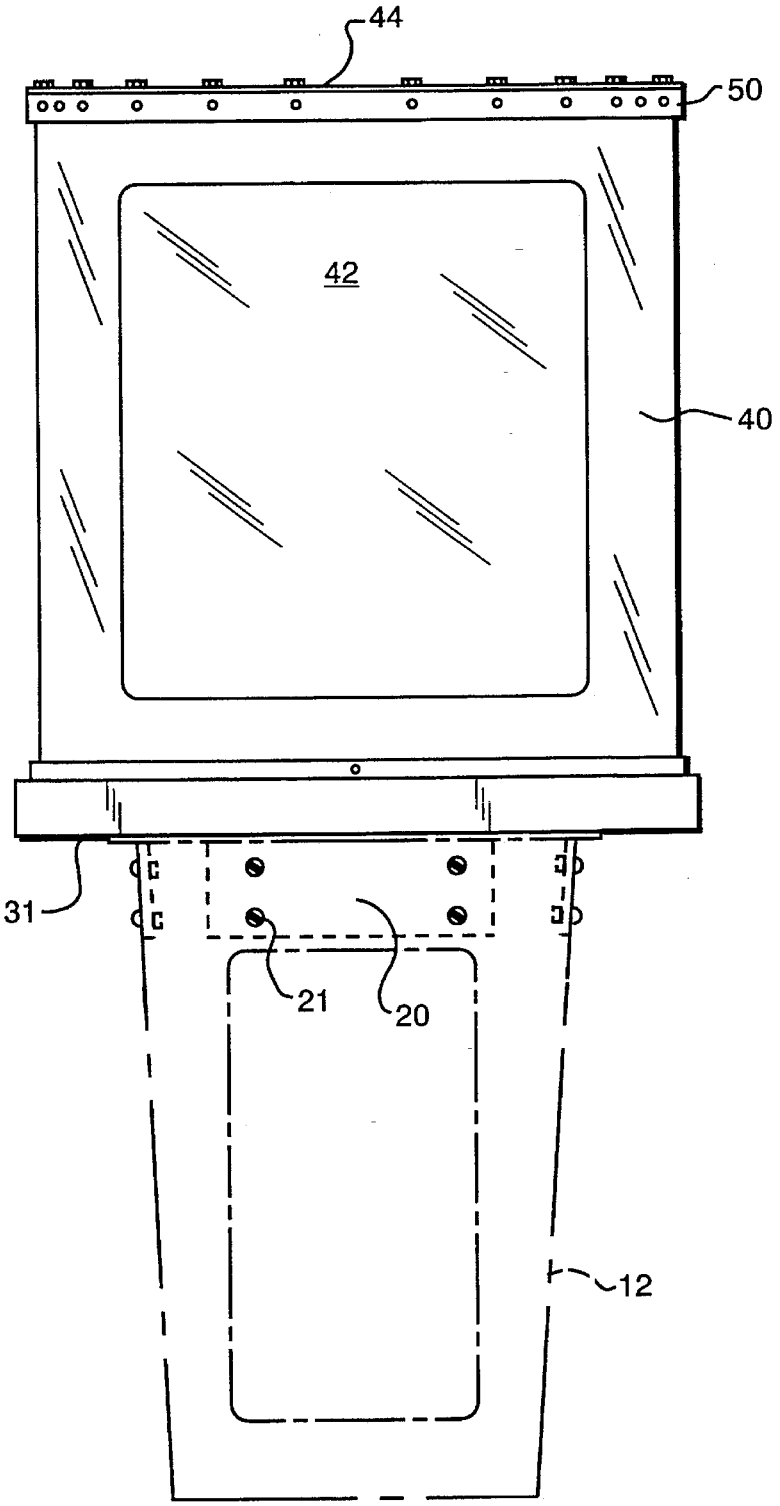
FIG. 8 is a front view of the preferred embodiment of the attachment method used to secure the enclosure apparatus in place on a typical aerial bucket.

Enclosure apparatus 10 rests on top of bucket 12 and is secured in place using one of several attachment methods. The preferred method is shown in FIG. 8. In the preferred embodiment, brace 20 is on the inside of bucket 12 and is shaped to match the contour of the inside surface 14 of bucket 12. Brace 20 preferably extends about 1 foot down into bucket 12. Brace 20 could also be integral with base 30, rather than attached to base 30 as shown. Brace 20 is fastened to bucket 12 through surface 14 using bolts 21 or other suitable fastening techniques that are well known in the art. A non-conductive material such as fiberglass is suitable to form brace 20. Attachment of brace 20 to bucket 12 requires drilling holes (not shown) through bucket 12 corresponding to the diameter of bolt 21. Once bolt 21 is installed, then a nut (not shown) is ready to secure the two items.

Figure 9:
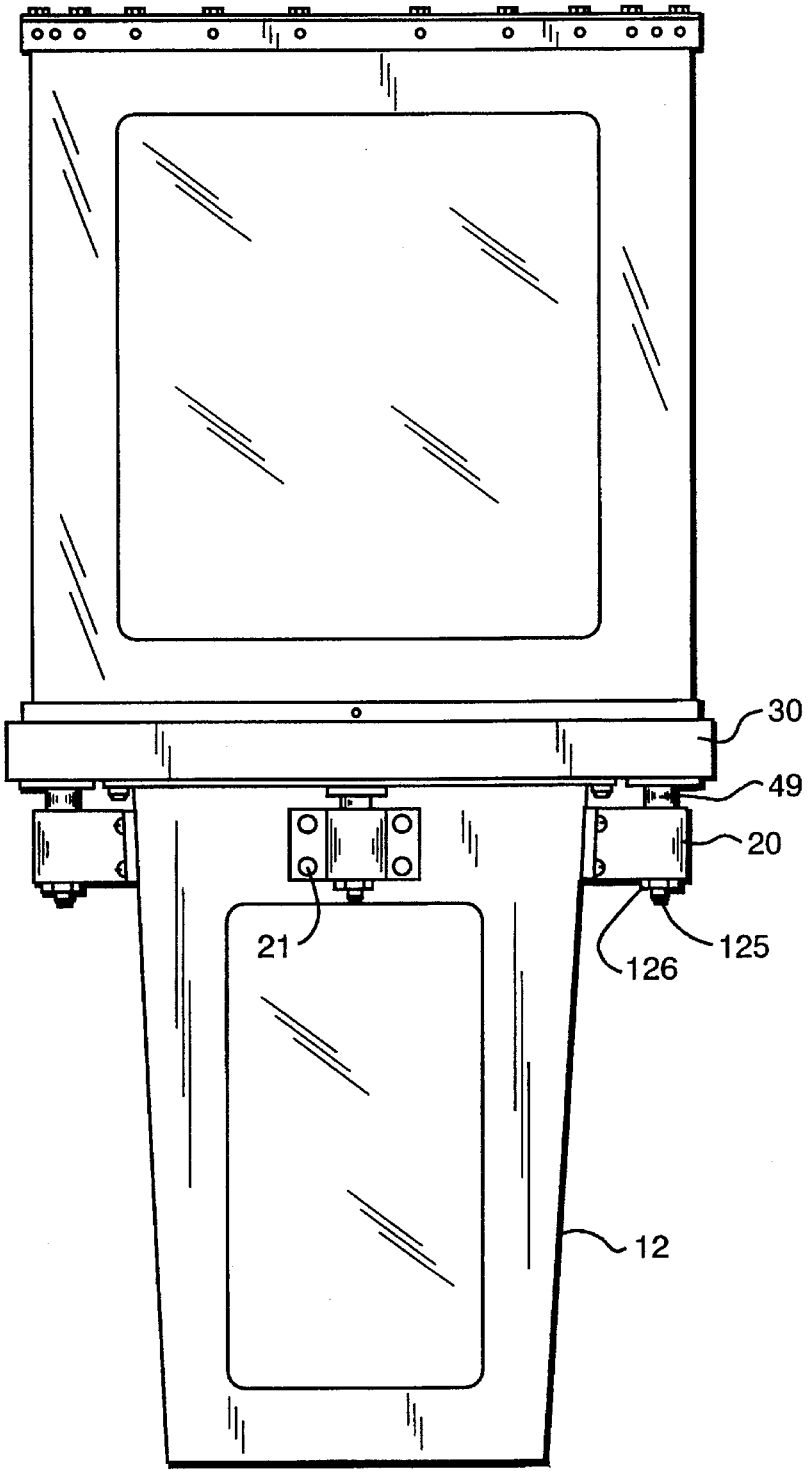
FIG. 9 is a front view of an alternate embodiment of the braces used to secure the enclosure apparatus in place on a typical aerial bucket.

Alternate embodiments of brace 20 can be easily substituted without effecting the overall performance of invention 10. For example, referring again to FIG. 1, braces 20 are spaced two per side of bucket 12 and are shaped so that brace end 22 sits flush with wall 14 of bucket 12 while brace end 24 sits flush with underside 31 of base 30. As shown in FIG. 9, another possible method of attachment is shown. In this version, braces 20 are attached to bucket 12 via bolts 21 as before. However, pins 49, that are fastened to base retainer 30 can be releasably inserted into braces 20 and secured by nut and bolts. There is one brace per wall on bucket 12, just as in the previous embodiment. For this particular configuration, shaft 125 extends from base retainer 30 and is inserted through the opening of brace 20. Once shaft 125 has been inserted, nut 126 is tightened. Other arrangements are also possible.

To remove enclosure apparatus 10 from bucket 12, simply loosen nuts and remove bolts 21 so that enclosure apparatus 10 can be lifted off. End 24 of brace 20 is attached to underside 31 of base retainer 30 via screws 25. Screw 25, bolt 21 and nuts are preferably constructed out of a non-conductive material, such as nylon.

Figure 2:
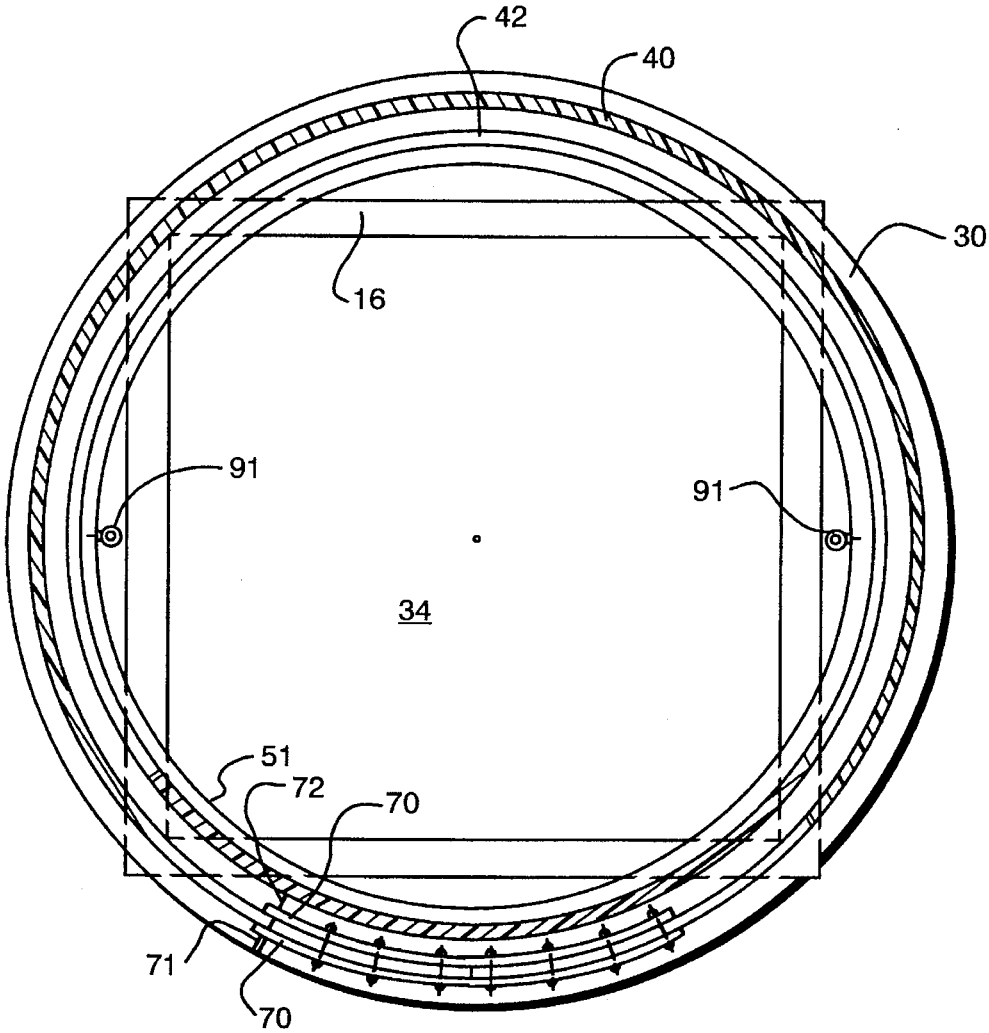
FIG. 2 is a top cross-sectional view of the enclosure apparatus along section line 2—2 of FIG. 1.
Figure 4:
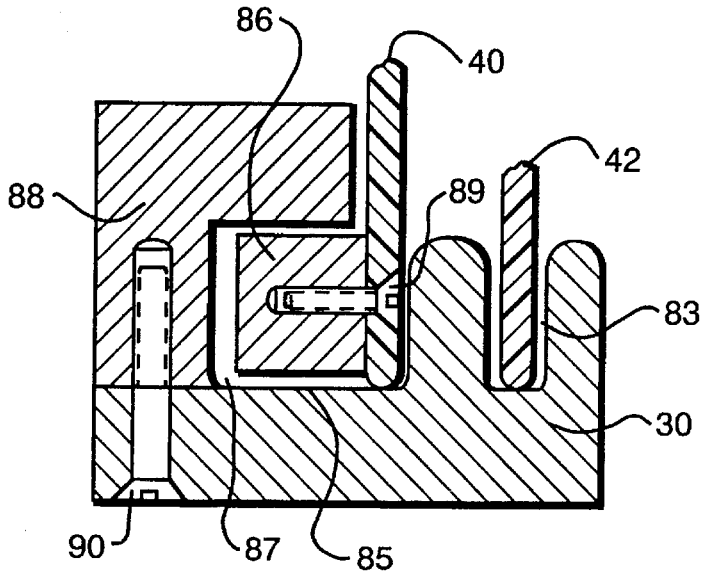
FIG. 4 is a cross-sectional view of the base retainer along section line 4—4 of FIG. 1.

Base retainer 30 functions to retain wall 40 and window 42, yet allows individual rotation in a set of tracks (see FIG. 4). FIG. 2 is a top cross-sectional view of base retainer 30 along section line 2—2 of FIG. 1. Base retainer underside 31 rests on corner surface 16 of bucket 12. Opening 34 of base retainer 30 as defined by inner perimeter 51 is large enough so that worker 15 has sufficient room to maneuver. Base retainer 30 is preferably formed out of non-conductive material, such as fiberglass. Metal materials of any type that would be exposed on the outside surface of invention 10 should be avoided in order to provide insulation for worker 15 should he come in contact with electrical power lines and to also avoid lightening strikes.

Window 42 and wall 40 are preferably constructed of a sturdy transparent polycarbonate plastic, such as LEXAN. An acceptable thickness of the LEXAN material would be on the order of an ⅛ inch. A material of this type allows worker 15 to view his surroundings with 360 degree visibility as well as allow natural light into the enclosure.

As shown in FIG. 1, splice plates 70 are used to connect wall 40 together where window opening 45 is located. For instance, the LEXAN material could be in a sheet size form that is cut to the proper dimensions and then wrapped around to be joined together by splice plates 70. Splice plates 70 are also manufactured out of a non-conductive material and consist of an inner and outer piece, as shown in FIG. 2. Connection of splice plates 70 to wall 40 is accomplished by a plurality of nuts 71 and bolts 72. Nuts and bolts 71 pass through wall 40 and is tightened against inside and outside splice plates 70. Use of a non-conductive material such as nylon is acceptable for nuts 71 and bolts 72.

Window opening 45, which is cut out of wall 40, should be at least equal in width to that of bucket 12, preferably greater, in order to allow worker 15 sufficient accessibility to the outside of enclosure apparatus 10. The height of wall 40 can vary, but should be selected to accommodate tall workers 15. Various dimensions of window opening 45 can be easily varied without effecting the overall performance of invention 10. The width of window 42 overlaps window opening 45 by a couple of inches so that window 45 can adequately close off window opening 45 when positioned to do so. Once window 42 is positioned to close off window opening 45, worker 15 is isolated from the environmental elements and thus permits him to perform his tasks within a protective enclosure.

Individual rotation of window 42 and wall 40 while bucket 12 remains in a fixed position allows worker 15 to better position himself to reach his work objective outside of bucket 12 rather than having to reposition the boom (not shown).

Figure 3:
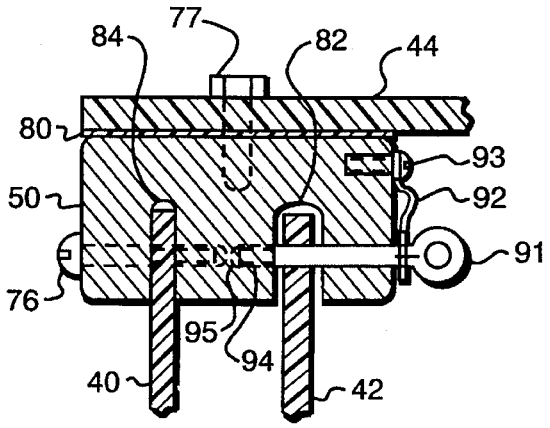
FIG. 3 is a cross-sectional view of the top retainer along section line 3—3 of FIG. 1.

FIG. 3 is a cross-sectional view of top retainer 50 along section line 3—3 of FIG. 1. Top retainer 50 is circular in shape with an opening (not shown) in the center, corresponding to opening 34 of base retainer 30. Wall 40 is inserted into groove 84 and is further secured to top retainer 50 via a plurality of screws 76. Likewise, roof 44 is securely attached to top retainer 50 via a plurality of screws 77. Roof 44 is constructed of the same material as wall 40 and window 42. Selection of this type of material allows worker 15 to have full visibility overhead while also allowing light to enter into the enclosure. Gasket 80 is placed between roof 44 and top retainer 50 in order to seat roof 44 to top retainer 50.

When wall 40 is rotated on base retainer 30, top retainer 50 and roof 44 are likewise rotated. Rotation of window 42 is separately controlled by worker 15. This is possible because upper window track 82 and lower window track 83 (see FIG. 4) allow enough space for window 42 to remain in place while wall 40 is rotated.

Pin 91 is used to secure window 42 in place during transportation. Two pins 91 are placed 180 degrees apart and are held in their general location by cord 92 which is attached to top retainer 50 by screw 93. Insertion of pin 91 into threadless hole 94 are both sized to provide a snug fit which is sufficient to hold window 42 in place during transportation. A plurality of holes (not shown) in the upper portion of window 42 is contained within track 82 allows pin 91 a multitude of locations for insertion. A tapered tip 95 to pin 91 makes insertion through window 42 easier to accomplish.

FIGS. 4–7 are cross-sectional view of various embodiments of base retainer 30 along section lines 4—4, 5—5, 6—6, 7—7 of FIG. 1, respectively. The preferred embodiment of base retainer 30 i shown in FIG. 5. The simplest method is shown in FIG. 4. This method provides a simple and cost effective means of enabling this aspect of invention 10. Window 42 rest within track 83 of base retainer 30 while wall 40 rests on non-ball bearing surface 85 of base retainer 30. A track used for rotation by wall 40 is created with ridge 86 matching the contour of gap 87 as defined by the addition of lip 88 to base retainer 30. A plurality of recessed screws 89 secure ridge 86 to wall 40. Ridge 86 runs the length of the entire perimeter of wall 40. Lip 88 is attached to base retainer 30 with a plurality of screws 90. Construction of lip 88 and ridge 86 is out of the same material selected for top retainer 50 and base retainer 30. An acceptable material for screws 89 and 90 is galvanized steel.

Figure 5:
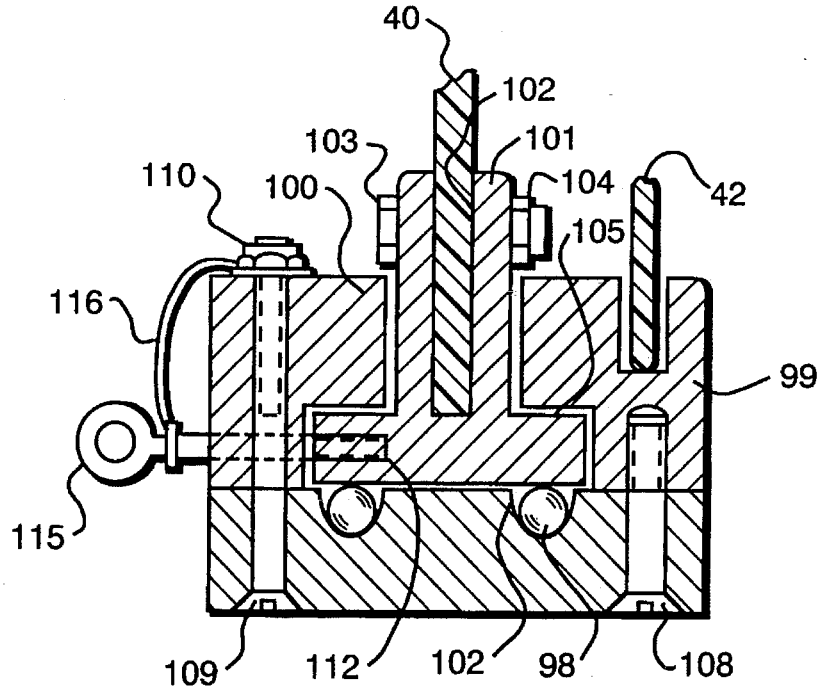
FIG. 5 is a cross-sectional view of an alternate embodiment of the base retainer along section line 5—5 of FIG. 1.

FIG. 5 is a cross-sectional view of the preferred embodiment of base retainer 30 along section line 5—5 of FIG. 1. In this configuration, wall 40 rides on ball bearings 98 to aid in its rotation. Base retainer 30 consist of an inside lip 99, an outside lip 100 and center ridge 101. Center ridge 101 has wall 40 firmly placed within groove 102 and further secured by a plurality of bolts 103 and nuts 104. Lips 99 and 100 are dimension to retain center ridge 101 to base retainer 30 by covering surface 105 of center rail 101. Inside lip 99 is secured to base retainer 30 by a plurality of recessed screws 108. Lower window track 83 is part of inside lip 99. Outside lip 100 is secured to base retainer 30 by a plurality of recessed bolts 109 and corresponding nuts 110.

Pin 115 is used to secure wall 40 from rotating during transportation. Cord 116 prevents pin 115 from being lost or misplaced and is connected to pin 115 and secured at the other end by nut 110 and bolt 109. Center ridge 101 has a plurality of travel pin holes 112 to make it easier to find a hole to connect with pin 115.

Figure 6:
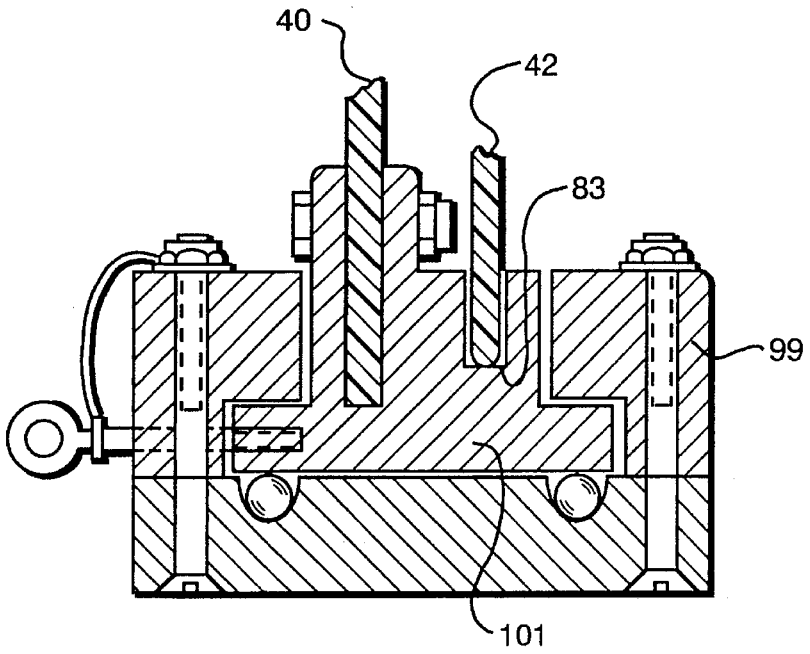
FIG. 6 is a cross-sectional view of an alternate embodiment of the base retainer along section line 6—6 of FIG. 1.

FIG. 6 is a cross-sectional view of another alternate embodiment of base retainer 30 along section line 6—6 of FIG. 1. This configuration has window track 83 as part of center ridge 101. Center ridge 101 and inside lip 99 are modified in their contours to accommodate this particular configuration.

Figure 7:
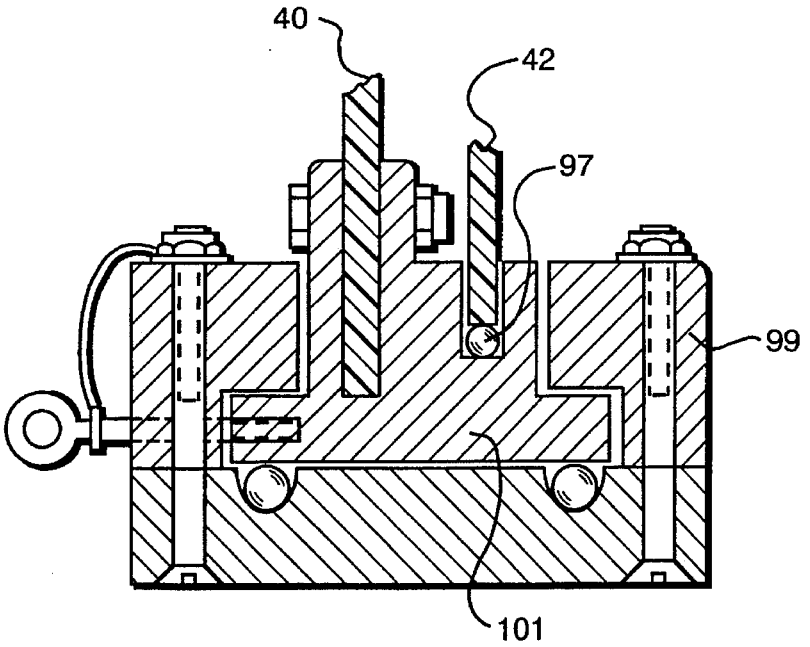
FIG. 7 is a cross-sectional view of the preferred embodiment of the base retainer along section line 7—7 of FIG. 1.

FIG. 7 is a cross-sectional view of still another alternate embodiment of base retainer 30 along section line 7—7 of FIG. 1. This embodiment provides the best sliding characteristics since each sliding part runs on a ball bearing. However, the deluxe version may not be required in most situations as window can expected to sufficiently slidable without bearings 97. This configuration is the deluxe version since it depicts window 42 also riding on ball bearings 97 to aid in its rotation.

FIG. 8 is a front view of an alternate embodiment of braces 20 used to secure enclosure apparatus 10 in place on a typical aerial bucket 12. Brace 20 is shaped to match the contour of the outside surface 14 of bucket 12 and to the base retainer underside 31. A plurality of nuts and bolts 21 secure brace 20 to bucket wall 14 while a plurality of screws 25 secure brace 20 to base retainer underside 31.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An enclosure apparatus for an aerial bucket comprising:

a substantially circular base having a base wall channel, a base window channel, an opening centered therein;

a substantially circular top having a top wall channel, a top window channel and a substantially transparent roof;

a cylindrical wall that is substantially transparent, said wall fixed within said top wall channel of said circular top and rotatably slidably disposed within said base wall channel of said base, said wall further having a window opening having a width;

a cylindrical window also substantially transparent, having substantially the same radius of curvature of said wall, said window dimensioned to correspond to said window opening in said wall, said window rotatably slidably disposed between said top window channel of said top and said base window channel of said base such that said window opening within said wall can be selectively opened up to the full width of said window opening by a user sliding said window;

attachment means for rigidly but removably attaching said base to said bucket;

wherein the user can rotate said wall to place said window opening in any desired position, said position being independent of the position of said bucket.

2. The enclosure apparatus of claim 1 wherein said base wall channel further comprises bearing means for facilitating the sliding rotation of said wall within said base wall channel.

3. The enclosure apparatus of claim 1 wherein said window wall channel further comprises bearing means for facilitating the sliding rotation of said window within said base window wall channel.

4. The enclosure apparatus of claim 1 wherein said wall further comprises:

a single rectangular section of plastic material, at least one pair of splice plates that is fasten on either side of said rectangular section to cause said section to be joined to form a cylinder.

5. The enclosure apparatus of claim 1 wherein said top and said window further comprises a key opening; a key adapted to fit within said key opening in said top and said window, such that when said key is inserted, said window is prevented from sliding within said window channels.

6. The enclosure apparatus of claim 1 wherein said attachment means further comprises a plurality of plates removably mounted to said base and said bucket such said enclosure apparatus is securely but removably fastened to said bucket.

7. The enclosure apparatus of claim 6 wherein said plates mount on the inside of said bucket.

8. The enclosure apparatus of claim 7 wherein said plates extend approximately one foot from the top of said bucket.

* * * * *